US012624868B2

(12) United States Patent
Pan et al.

(10) Patent No.: US 12,624,868 B2
(45) Date of Patent: May 12, 2026

(54) TRANSCRITICAL CARBON DIOXIDE SINGLE-STAGE AND DOUBLE-STAGE COMPRESSION HOT WATER SYSTEM AND CONTROL METHOD THEREFOR

(71) Applicant: JIANGSU SUJING GROUP CO., LTD., Suzhou (CN)

(72) Inventors: Hao Pan, Suzhou (CN); Dan Xiong, Suzhou (CN); Xiaoliang Tang, Suzhou (CN); Jun You, Suzhou (CN); Qiang Kang, Suzhou (CN); Xiaofei Song, Suzhou (CN)

(73) Assignee: JIANGSU SUJING GROUP CO., LTD., Suzhou (CN)

( * ) Notice: Subject to any disclaimer, the term of this patent is extended or adjusted under 35 U.S.C. 154(b) by 0 days.

(21) Appl. No.: 18/574,909

(22) PCT Filed: May 26, 2022

(86) PCT No.: PCT/CN2022/095094

§ 371 (c)(1),
(2) Date: Dec. 28, 2023

(87) PCT Pub. No.: WO2023/123843

PCT Pub. Date: Jul. 6, 2023

(65) Prior Publication Data

US 2024/0353158 A1 Oct. 24, 2024

(30) Foreign Application Priority Data

Dec. 28, 2021 (CN) ..... 202111623041.2

(51) Int. Cl.

| | |
|---|---|
| ***F25B 41/20*** | (2021.01) |
| ***F25B 47/02*** | (2006.01) |
| ***F25B 49/02*** | (2006.01) |

(52) U.S. Cl.
CPC ..... *F25B 41/20* (2021.01); *F25B 47/02* (2013.01); *F25B 49/022* (2013.01); *F25B 2400/23* (2013.01); *F25B 2600/2501* (2013.01)

(58) Field of Classification Search
CPC ..... F25B 41/20; F25B 47/02; F25B 49/022; F25B 2400/23; F25B 2600/2501
(Continued)

(56) References Cited

FOREIGN PATENT DOCUMENTS

| | | | |
|---|---|---|---|
| CN | 205318743 | U | 6/2016 |
| CN | 107726656 | A | 2/2018 |

(Continued)

OTHER PUBLICATIONS

International Search Report for PCT /CN2022/095094 mailed Sep. 29, 2022.

*Primary Examiner* — Nael N Babaa
(74) *Attorney, Agent, or Firm* — Schmeiser, Olsen & Watts LLP

(57) ABSTRACT

A hot water system with transcritical carbon dioxide single-stage or double-stage compression and a control method therefor is provided. The hot water system includes a first-stage compressor, a first heat exchanger for exchanging heat with cooling water on user side, a second-stage compressor, a second heat exchanger for exchanging heat with the cooling water on user side, a third heat exchanger for exchanging heat between a liquid phase refrigerant and a gas phase refrigerant, an expansion valve, a fourth heat exchanger for exchanging heat with ambient air, a buffer water tank, a first proportional valve, a second proportional valve, a third proportional valve, a fourth proportional valve, a defrosting valve, and a refrigerant circuit bypass valve. The hot water system can switch between the single-stage compression ad the double-stage compression in high-temperature and low-temperature weather, ensuring that the
(Continued)

system has good heating capacity and energy efficiency ratio.

17 Claims, 1 Drawing Sheet

(58) Field of Classification Search
USPC ..... 62/196.1
See application file for complete search history.

(56) References Cited

FOREIGN PATENT DOCUMENTS

| | | | |
|---|---|---|---|
| CN | 207585127 | U | 7/2018 |
| CN | 209484873 | U | 10/2019 |
| CN | 209605439 | U | 11/2019 |
| CN | 110736262 | A | 1/2020 |
| CN | 114165936 | A | 3/2022 |

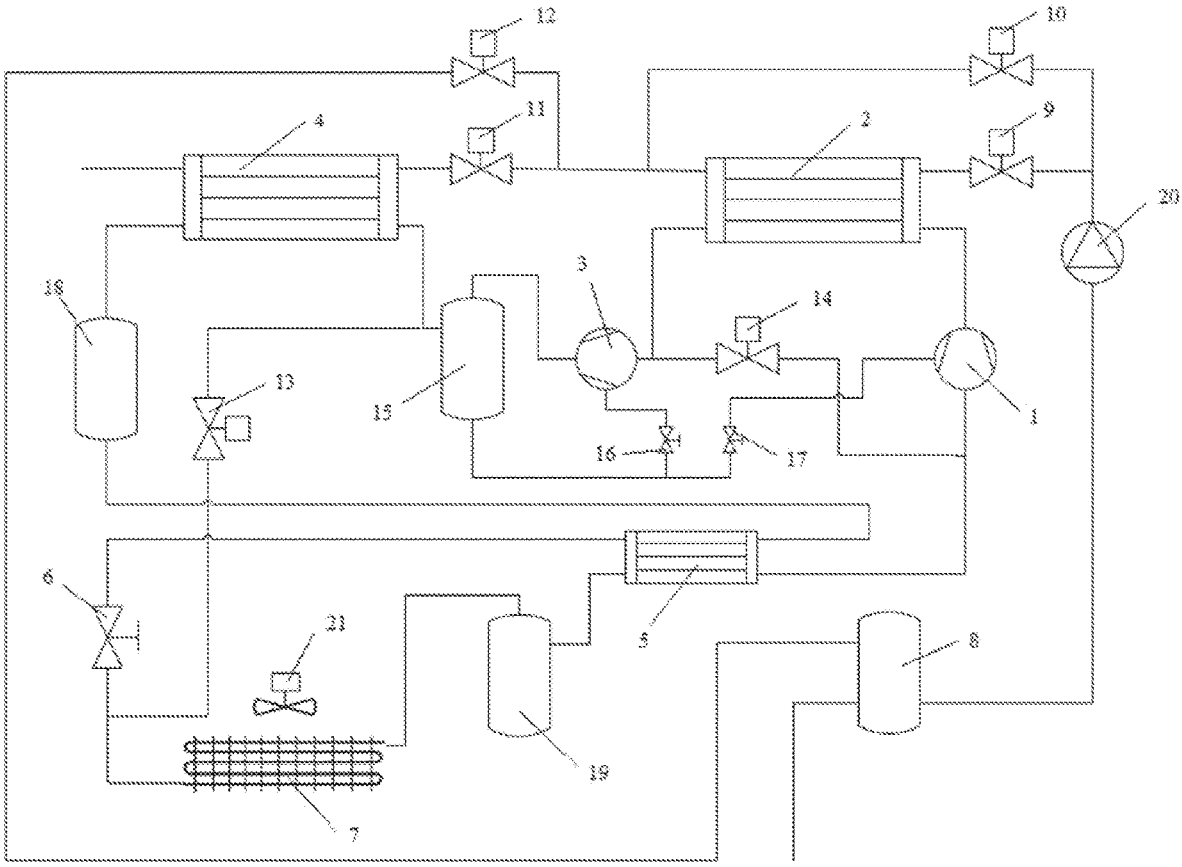
12
10
4
11
2
9
20
3
14
18
13
15
1
16
17
6
21
5
8
19
7

TRANSCRITICAL CARBON DIOXIDE SINGLE-STAGE AND DOUBLE-STAGE COMPRESSION HOT WATER SYSTEM AND CONTROL METHOD THEREFOR

CROSS-REFERENCE TO RELATED APPLICATIONS

This application claims priority to PCT/CN2022/095094, filed on May 26, 2022, which claims priority to Chinese Application No. 202111623041.2, filed on Dec. 28, 2021, the entire contents both of which are hereby incorporated by reference.

FIELD OF TECHNOLOGY

The following relates to the field of transcritical carbon dioxide heat pump technology, and specifically relates to a hot water system for transcritical carbon dioxide single-stage or double-stage compression and a control method therefor.

BACKGROUND

Carbon dioxide has good environmental properties with an ODP (Ozone depletion potential) value of 0 and a GWP (Global warming potential) value of 1. As a natural working medium, carbon dioxide also has good physical properties at low temperatures. The transcritical carbon dioxide heat pump system, as an environmentally friendly, efficient, stable, and reliable comprehensive utilization system of thermal energy, is often used as building air conditioner to meet the needs of winter heating and summer cooling in large buildings in the commercial and public service fields. Research has shown that the maximum temperature inside the gas cooler of a transcritical carbon dioxide heat pump system can reach 140° C., therefore the transcritical carbon dioxide heat pump system can provide hot water at higher temperatures.

However, when producing high-temperature water at low temperatures, the water heater of the carbon dioxide heat pump currently faces a series of problems such as severe attenuation of energy efficiency ratio and heat generation of the system, as well as an increase in exhaust temperature. At the same time, the pressure control of intermediate stage and high-pressure, as well as the control of outlet water temperature of the current transcritical carbon dioxide double-stage compression system, are not improved enough to achieve the switching between single-stage and double-stage compression, resulting in the system being unable to operate normally in high-temperature weather, and may also have false defrosting actions.

SUMMARY

An aspect relates to an improved hot water system for transcritical carbon dioxide single-stage or double-stage compression, which can switch between the single-stage compression and the double-stage compression in high-temperature and low-temperature weather, ensuring that the system has good heating capacity and energy efficiency ratio when producing high-temperature water in both high-temperature and low-temperature weather, and which, at the same time, also solves the control problem of outlet temperature and defrosting problem in the transcritical carbon dioxide single-stage or double-stage compression system.

A hot water system with transcritical carbon dioxide single-stage or double-stage compression is provided, comprising: a first-stage compressor, a first heat exchanger for heat exchange with user side cooling water, a second-stage compressor, a second heat exchanger for exchanging heat with cooling water on user side, a third heat exchanger for exchanging heat between a liquid phase refrigerant and a gas phase refrigerant, an expansion valve, a fourth heat exchanger for exchanging heat with ambient air, a buffer water tank, a first proportional valve, a second proportional valve, a third proportional valve, a fourth proportional valve, a defrosting valve, and a refrigerant circuit bypass valve.

Wherein, the first-stage compressor, the first heat exchanger, the second-stage compressor, the second heat exchanger, a liquid phase refrigerant flow side of the third heat exchanger, the expansion valve, the fourth heat exchanger, and a gas phase refrigerant flow side of the third heat exchanger are sequentially circularly connected.

Two ends of the refrigerant circuit bypass valve are respectively connected to the gas phase refrigerant flow side of the third heat exchanger and an air suction inlet of the second-stage compressor, and two ends of the defrosting valve are respectively connected to an exhaust vent of the second-stage compressor and a refrigerant inlet of the fourth heat exchanger.

The buffer water tank, the first proportional valve, the first heat exchanger, the third proportional valve, and the second heat exchanger are sequentially connected, an inlet of the second proportional valve is connected to the buffer water tank, an outlet of the second proportional valve is respectively connected to an inlet of the third proportional valve and an inlet of the fourth proportional valve, the inlet of the fourth proportional valve is further connected to the first heat exchanger, and an outlet of the fourth proportional valve is connected to the buffer water tank.

In some embodiments, the hot water system with transcritical carbon dioxide single-stage or double-stage compression further comprises a compressor oil separator, the compressor oil separator comprises an oil separator refrigerant inlet, an oil separator refrigerant outlet, and an oil separator lubricating oil outlet, the oil separator refrigerant inlet is connected to the exhaust vent of the second-stage compressor, and the oil separator refrigerant outlet is respectively connected to the second heat exchanger and the defrosting valve, and the oil separator lubricating oil outlet is respectively connected to an oil return opening of the first-stage compressor and an oil return opening of the second-stage compressor.

In some embodiments, the hot water system with transcritical carbon dioxide single-stage or double-stage compression further comprises a first oil circuit solenoid valve and a second oil circuit solenoid valve, two ends of the first oil circuit solenoid valve is respectively connected to the oil separator lubricating oil outlet and the oil return opening of the second-stage compressor, and two ends of the second oil circuit solenoid valve is respectively connected to the oil separator lubricating oil outlet and the oil return opening of the first-stage compressor.

In some embodiments, the hot water system with transcritical carbon dioxide single-stage or double-stage compression further comprises a reservoir, which is respectively connected to a refrigerant outlet of the second heat exchanger and the liquid phase refrigerant flow side of the third heat exchanger; and/or, the hot water system with transcritical carbon dioxide single-stage or double-stage compression further comprises a gas-liquid separator, which is respectively connected to the fourth heat exchanger and the gas phase refrigerant flow side of the third heat exchanger.

In some embodiments, the hot water system with transcritical carbon dioxide single-stage or double-stage compression further comprises a water pump, which is respectively connected to the buffer water tank, the first proportional valve, and the second proportional valve.

In some embodiments, the hot water system with transcritical carbon dioxide single-stage or double-stage compression further comprises a fan for blowing ambient air to the fourth heat exchanger and directly facing the fourth heat exchanger.

In some embodiments, the fourth heat exchanger is a finned tube evaporator.

In some embodiments, the first-stage compressor is a variable frequency compressor, and the second-stage compressor is a fixed frequency compressor.

In some embodiments, the hot water system with transcritical carbon dioxide single-stage or double-stage compression further comprises an environmental temperature sensor, a buffer water tank outlet temperature sensor, a first heat exchanger outlet temperature sensor, a second heat exchanger outlet temperature sensor, a first-stage compressor exhaust pressure sensor, a first-stage compressor exhaust temperature sensor, a first-stage compressor suction pressure sensor, a first-stage compressor suction temperature sensor, a second-stage compressor exhaust pressure sensor, a second-stage compressor exhaust temperature sensor, a second-stage compressor suction pressure sensor, a second-stage compressor suction temperature sensor, a second heat exchanger refrigerant outlet temperature sensor, a fourth heat exchanger surface temperature sensor, and a fourth heat exchanger refrigerant evaporation pressure sensor:

wherein, the buffer water tank outlet temperature sensor is arranged at an outlet of the buffer water tank, the first heat exchanger outlet temperature sensor is arranged at an outlet of the first heat exchanger, the second heat exchanger outlet temperature sensor is arranged at the outlet of the second heat exchanger, the first-stage compressor exhaust pressure sensor and the first-stage compressor exhaust temperature sensor are respectively arranged at an exhaust vent of the first-stage compressor, the first-stage compressor suction pressure sensor and the first-stage compressor suction temperature sensor are respectively arranged at an air suction inlet of the first-stage compressor, the second-stage compressor exhaust pressure sensor and the second-stage compressor exhaust temperature sensor are respectively arranged at the exhaust vent of the second-stage compressor, the second-stage compressor suction pressure sensor and the second-stage compressor suction temperature sensor are respectively arranged at the air suction inlet of the second-stage compressor, the second heat exchanger refrigerant outlet temperature sensor is arranged at an refrigerant outlet of the second heat exchanger, and the fourth heat exchanger surface temperature sensor and the fourth heat exchanger refrigerant evaporation pressure sensor are arranged on the fourth heat exchanger.

Another aspect of the disclosure relates to a control method for the above-mentioned hot water system with transcritical carbon dioxide single-stage or double-stage compression, comprising: a step of controlling operation of the double-stage compression, a step of controlling operation of the single-stage compression, and steps of detecting an evaporation pressure $P_0$ of the hot water system, a temperature $t_{gout}$ of the refrigerant at the outlet of the second heat exchanger, and a surface temperature $t_e$ of the fourth heat exchanger, respectively, recording an optimal exhaust pressure of the first-stage compressor as $P_{1,o}$, and recording an optimal exhaust pressure of the second-stage compressor as $P_{2,o}$.

if the hot water system is in a mode of the double-stage compression, the step of controlling operation of the double-stage compression comprises:

making the refrigerant circuit bypass valve in a closed state, solving the following formulas simultaneously:

$$P_{1,o} = \sqrt{P_0 \cdot P_{2,o}} + \Delta P$$

$$P_{2,0} = f_1(t_{gout}, P_{1,0}, t_e)$$

$$f_1(t_{gout}, P_{1,0}, t_e) = (3.896 - 0.0223 * t_e) \times t_{gout} + (0.496 * t_e - 10.55) + 1.032 \times P_{1,0}^{0.13}$$

wherein, $\Delta P$ is the pressure correction value and ranges from −5 bar to 10 bar, using obtained $P_{1,o}$ and $P_{2,o}$ as target values and comparing them with an actual exhaust pressure $P_1$ of the first-stage compressor and an actual exhaust pressure $P_2$ of the second-stage compressor which are actually detected, and according to a difference between $P_1$ and $P_{1,o}$ and a difference between $P_2$ and $P_{2,o}$, adjusting an opening of the expansion valve and an operating frequency of the first-stage compressor to make $P_1$ close to $P_{1,o}$, and $P_2$ close to $P_{2,o}$;

if the hot water system is in a mode of the single-stage compression, the step of controlling operation of the single-stage compression comprises:

making the refrigerant circuit bypass valve in an open state, shutting down the first-stage compressor, adjusting an opening of the first proportional valve to 0 and an opening of the second proportional valve to 100%, solving the following formulas:

$$P_{2,0} = f_2(t_{gout}, P_0, t_e)$$

$$f_2(t_{gout}, P_0, t_e) = (3.896 - 0.0223 * t_e) \times t_{gout} + (0.496 * t_e - 10.55) + 1.032 \times P_0^{0.13}$$

wherein, $\Delta P$ is the pressure correction value and ranges from −5 bar to 10 bar, using an obtained $P_{2,o}$ as a target value and comparing it with the actual exhaust pressure $P_2$ of the second-stage compressor actually detected, $\Delta P$ is the pressure correction value and ranges from −5 bar to 10 bar, and according to the difference between $P_2$ and $P_{2,o}$, adjusting the opening of the expansion valve to make $P_2$ close to $P_{2,o}$.

In some embodiments, the control method further comprises a step of controlling an outlet temperature of the second heat exchanger, comprising:

adjusting the openings of the first proportional valve and the second proportional valve respectively to control the degree of suction superheat $\Delta t_{s2}$, and controlling $\Delta t_{s2}$ to be 5 K-10 K; adjusting the openings of the third proportional valve and the fourth proportional valve respectively, recording the opening of the first proportional valve as $EXP_1$, the opening of the second proportional valve as $EXP_2$, the opening of the third proportional valve as $EXP_3$, and the opening of the fourth proportional valve as $EXP_4$, and controlling $EXP_1+EXP_2-EXP_3+EXP_4+\Delta EXP$, wherein $\Delta EXP$ is the opening compensation for hydraulic loss and is 3%-6%.

In some embodiments, the control method further comprises a step of controlling defrosting, comprising:

if the surface temperature $t_c$ of the fourth heat exchanger is lower than a setting temperature $t_1$ within a duration $T_1$, the suction pressure $P_1$ of the second-stage compressor is lower than a setting pressure $P_{1s}$ within a duration $T_2$, and $$T_1^a * T_2^{1-a} = T,$$

starting defrosting, wherein, $$a = 0.104 - 0.014 * t_a + 2.78 * 10^{-4} * t_a^2 + 4.04 * 10^{-6} * t_a^3 + 2.35 * 10^{-7} * t_a^4$$

T is 30 min to 60 min; and when starting defrosting, closing the expansion valve, shutting down the fan, closing the first proportional valve, opening the defrosting valve, making the first-stage compressor runs to the frequency $Hz_1$, which is an operational frequency of the first-stage compressor and is 50 Hz to 65 Hz, and making the second-stage compressor does not shutdown.

Due to the use of the above technical solutions, the present disclosure has the following advantages:

the hot water system with transcritical carbon dioxide single-stage or double-stage compression and a control method therefor of the present disclosure solve the intermediate pressure control problem of transcritical carbon dioxide double-stage compression, ensuring that the system can be in the optimal operating state under different working conditions, and can also achieve the switching of transcritical first-stage and double-stage compression, taking into account the operating conditions of high and low environmental temperatures. And the present disclosure also solves the defrosting problem of the hot water system with transcritical carbon dioxide single-stage or double-stage compression, improves defrosting efficiency, and reduces false defrosting actions.

In addition, the hot water system with transcritical carbon dioxide single-stage or double-stage compression of the present disclosure not only achieves heat recovery of the single-stage compression, but also achieves precise control of the outlet temperature of the system.

BRIEF DESCRIPTION

Some of the embodiments will be described in detail, with references to the following FIGURE, wherein like designations denote like members, wherein:

FIG. 1 is a schematic structure diagram of a hot water system with transcritical carbon dioxide single-stage or double-stage compression in an embodiment of the present disclosure;

wherein, 1—first—stage compressor; 2—first heat exchanger; 3—second-stage compressor; 4—second heat exchanger; 5—third heat exchanger; 6—expansion valve; 7—fourth heat exchanger; 8—buffer water tank; 9—first proportional valve; 10—second proportional valve; 11—third proportional valve; 12—fourth proportional valve; 13—defrosting valve; 14—refrigerant circuit bypass valve; 15—compressor oil separator; 16—first oil circuit solenoid valve; 17—second oil circuit solenoid valve; 18—reservoir; 19—gas-liquid separator; 20—water pump; 21—fan.

DETAILED DESCRIPTION

In order to make the above purposes, features and advantages of the present disclosure more clearly understood, the present disclosure will be described in detail below with reference to the accompanying drawings and specific embodiments. In the following description, numerous specific details are set forth in order to provide a thorough understanding of the present disclosure. However, the present disclosure can be implemented in many other ways different from those described herein, and those skilled in the conventional art can make similar improvements without departing from the connotation of the present disclosure, therefore, the present disclosure is not limited by the specific embodiments disclosed below.

In the description of the present disclosure, "a plurality of" means at least two, such as two, three, etc., unless otherwise expressly and specifically defined.

In the present disclosure, unless otherwise expressly specified and limited, the terms "mount", "communicate", "connect", "fix" and other terms should be understood in a broad sense, for example, it may be fixedly connected or detachably connected, or integrated; it may be mechanically connected or electrically connected; it can be directly connected or indirectly connected through an intermediate medium, or it can be the internal communication of two elements or the interaction relationship between two elements. For those of ordinary skill in the conventional art, the specific meanings of the above terms in the present disclosure can be understood according to specific situations.

In the disclosure, unless otherwise expressly specified and limited, a first feature "on" or "under" a second feature may mean that the first feature is in direct contact with the second feature, or the first feature is in indirect contact with the second feature through an intermediate medium. Also, the first feature being "on", "above", or "over" the second feature may mean that the first feature is directly above or obliquely above the second feature, or simply means that the first feature is level higher than the second feature. The first feature being "under", "below" or "underneath" the second feature may mean that the first feature is directly below or obliquely below the second feature, or simply means that the first feature has a lower level than the second feature.

It should be noted that when an element is referred to as being "fixed to" or "disposed on" another element, it can be directly on the other element or intervening elements may also be present. When an element is referred to as being "connected to" another element, it can be directly connected to the other element or intervening elements may also be present.

The desired implementations of the present disclosure are explained below in detail combining with the accompanying drawings.

As shown in FIG. 1, this embodiment provides a hot water system with transcritical carbon dioxide single-stage or double-stage compression, which comprises: a first-stage compressor 1, a first heat exchanger 2 for heat exchange with user side cooling water, a second-stage compressor 3, a second heat exchanger 4 for heat exchange with user side cooling water, a third heat exchanger 5 for heat exchange between liquid phase refrigerant and gas phase refrigerant, an expansion valve 6, a fourth heat exchanger 7 for heat exchange with ambient air, a buffer water tank 8, a first proportional valve 9, a second proportional valve 10, a third proportional valve 11, a fourth proportional valve 12, a defrosting valve 13, and a refrigerant circuit bypass valve 14.

The first-stage compressor 1, the first heat exchanger 2, the second-stage compressor 3, the second heat exchanger 4, the liquid phase refrigerant flow side of the third heat exchanger 5, the expansion valve 6, the fourth heat exchanger 7, and the gas phase refrigerant flow side of the third heat exchanger 5 are sequentially circularly connected.

Two ends of the refrigerant circuit bypass valve 14 are respectively connected to the gas phase refrigerant flow side of the third heat exchanger 5 and an air suction inlet of the second-stage compressor 3, and two ends of the defrosting valve 13 are respectively connected to an exhaust vent of the second-stage compressor 3 and a refrigerant inlet of the fourth heat exchanger 7.

The buffer water tank 8, the first proportional valve 9, the first heat exchanger 2, the third proportional valve 11, and the second heat exchanger 4 are sequentially connected, an inlet of the second proportional valve 10 is connected to the buffer water tank 8, an outlet of the second proportional valve 10 is respectively connected to an inlet of the third proportional valve 11 and an inlet of the fourth proportional valve 12, the inlet of the fourth proportional valve 12 is further connected to the first heat exchanger 2, and an outlet of the fourth proportional valve 12 is connected to the buffer water tank 8.

In this embodiment, the hot water system with transcritical carbon dioxide single-stage or double-stage compression further comprises a compressor oil separator 15, wherein the compressor oil separator 15 comprises an oil separator refrigerant inlet, an oil separator refrigerant outlet, and an oil separator lubricating oil outlet, the oil separator refrigerant inlet is connected to the exhaust vent of the second-stage compressor 3, and the oil separator refrigerant outlet is respectively connected to the second heat exchanger 4 and the defrosting valve 13, and the oil separator lubricating oil outlet is respectively connected to an oil return opening of the first-stage compressor 1 and an oil return opening of the second-stage compressor 3.

In this embodiment, the hot water system with transcritical carbon dioxide single-stage or double-stage compression further comprises a first oil circuit solenoid valve 16 and a second oil circuit solenoid valve 17, wherein two ends of the first oil circuit solenoid valve 16 is respectively connected to the oil separator lubricating oil outlet and the oil return opening of the second-stage compressor 3, and two ends of the second oil circuit solenoid valve 17 is respectively connected to the oil separator lubricating oil outlet and the oil return opening of the first-stage compressor 1.

In this embodiment, the hot water system with transcritical carbon dioxide single-stage or double-stage compression further comprises a reservoir 18 and a gas-liquid separator 19, wherein the reservoir 18 is respectively connected to a refrigerant outlet of the second heat exchanger 4 and the liquid phase refrigerant flow side of the third heat exchanger 5, and the gas-liquid separator 19 is respectively connected to the fourth heat exchanger 7 and the gas phase refrigerant flow side of the third heat exchanger 5.

In this embodiment, the hot water system with transcritical carbon dioxide single-stage or double-stage compression further comprises a water pump 20 and a fan 21, wherein the water pump 20 is respectively connected to the buffer water tank 8, the first proportional valve 9 and the second proportional valve 10, and the fan 21 is used to blow ambient air to the fourth heat exchanger 7 and directly faces the fourth heat exchanger 7. Further, the water pump 20 and the fan 21 may be respectively a variable frequency water pump and a variable frequency fan.

In this embodiment, the first-stage compressor 1 is a variable frequency compressor, the second-stage compressor 3 is a fixed frequency compressor, and the fourth heat exchanger 7 is a finned tube evaporator.

In this embodiment, the hot water system with transcritical carbon dioxide single-stage or double-stage compression further comprises an environmental temperature sensor, a buffer water tank outlet temperature sensor, a first heat exchanger outlet temperature sensor, a second heat exchanger outlet temperature sensor, a first-stage compressor exhaust pressure sensor, a first-stage compressor exhaust temperature sensor, a first-stage compressor suction pressure sensor, a first-stage compressor suction temperature sensor, a second-stage compressor exhaust pressure sensor, a second-stage compressor exhaust temperature sensor, a second-stage compressor suction pressure sensor, a second-stage compressor suction temperature sensor, a second heat exchanger refrigerant outlet temperature sensor, a fourth heat exchanger surface temperature sensor, and a fourth heat exchanger refrigerant evaporation pressure sensor.

The buffer water tank outlet temperature sensor is arranged at the outlet of the buffer water tank 8, the first heat exchanger outlet temperature sensor is arranged at the outlet of the first heat exchanger 2, the second heat exchanger outlet temperature sensor is arranged at the outlet of the second heat exchanger 4, the first-stage compressor exhaust pressure sensor and the first-stage compressor exhaust temperature sensor are respectively arranged at an exhaust vent of the first-stage compressor 1, the first-stage compressor suction pressure sensor and the first-stage compressor suction temperature sensor are respectively arranged at an air suction inlet of the first-stage compressor 1, the second-stage compressor exhaust pressure sensor and the second-stage compressor exhaust temperature sensor are respectively arranged at the exhaust vent of the second-stage compressor 3, the second-stage compressor suction pressure sensor and the second-stage compressor suction temperature sensor are respectively arranged at the air suction inlet of the second-stage compressor 3, the second heat exchanger refrigerant outlet temperature sensor is arranged at the refrigerant outlet of the second heat exchanger 4, and the fourth heat exchanger surface temperature sensor and the fourth heat exchanger refrigerant evaporation pressure sensor are arranged on the fourth heat exchanger 7.

Further, in this embodiment, the first heat exchanger 2 is a condenser, and the second heat exchanger 4 is a gas cooler.

Further, in this embodiment, there may be one first-stage compressor 1 or the first-stage compressor 1 be composed of multiple compressors in series. There may be one second-stage compressor 3 or the second-stage compressor 1 be composed of multiple compressors in series.

Further, in this embodiment, the hot water system with transcritical carbon dioxide single-stage or double-stage compression further comprises a control system, which respectively communicates with the environmental temperature sensor, the buffer water tank outlet temperature sensor, the first heat exchanger outlet temperature sensor, the second heat exchanger outlet temperature sensor, the first-stage compressor exhaust pressure sensor, the first-stage compressor exhaust temperature sensor, the first-stage compressor suction pressure sensor, the first-stage compressor suction temperature sensor, the second-stage compressor exhaust pressure sensor, the second-stage compressor exhaust temperature sensor, the second-stage compressor suction pressure sensor, the second-stage compressor suction temperature sensor, the second heat exchanger refrigerant outlet temperature sensor, the fourth heat exchanger surface temperature sensor, the fourth heat exchanger refrigerant evaporation pressure sensor, the variable frequency first-stage compressor, the variable frequency fan, the variable frequency water pump, and the like.

This embodiment further provides a control method for the above-mentioned hot water system with transcritical carbon dioxide single-stage or double-stage compression, comprising a step of controlling operation of the double-stage compression, a step of controlling operation of the single-stage compression, and steps of detecting an evaporation pressure $P_0$ of the hot water system, a temperature $t_{gout}$ of the refrigerant at the outlet of the second heat exchanger, and a surface temperature $t_c$ of the fourth heat exchanger, respectively, recording an optimal exhaust pressure of the first-stage compressor as $P_{1,o}$, and recording an optimal exhaust pressure of the second-stage compressor as $P_{2,o}$.

If the hot water system with transcritical carbon dioxide single-stage or double-stage compression is in a mode of the double-stage compression, the step of controlling operation of the double-stage compression comprises: making the refrigerant circuit bypass valve 14 in a closed state, according to the formulas:

$$P_{1,o} = \sqrt{P_0 \cdot P_{2,o}} + \Delta P$$

$$P_{2,0} = f_1(t_{gout}, P_{1,0}, t_e)$$

$$f_1(t_{gout}, P_{1,0}, t_e) = (3.896 - 0.0223 * t_e) \times t_{gout} + (0.496 * t_e - 10.55) + 1.032 \times P_{1,0}^{0.13}$$

solving them simultaneously, using the obtained $P_{1,o}$ and $P_{2,o}$ as target values and comparing them with the actual exhaust pressure $P_1$ of the first-stage compressor 1 and the actual exhaust pressure $P_2$ of the second-stage compressor 3 actually detected, $\Delta P$ is the pressure correction value, ensuring that the calculated $P_{1,o}$ do not exceed the critical pressure of carbon dioxide gas, its specific value can be obtained through experiments, such as −5 bar to 10 bar, and according to the difference between $P_1$ and $P_{1,o}$ and the difference between $P_2$ and $P_{2,o}$, adaptively adjusting the opening of the expansion valve 6 and the operating frequency of the first-stage compressor 1 to make $P_1$ close to $P_{1,o}$, and $P_2$ close to $P_{2,o}$.

When $P_1 \geq P_{1,o}$+ [pressure deviation 1], the action trend of the expansion valve 6 is to open wider, and the adjustment speed of the expansion valve 6 is determined based on the difference between $P_1$ and $P_{1,o}$, the larger the difference is, the faster the speed is; the smaller the difference is, the slower the speed is.

When $P_1 \leq P_{1,o}$−[pressure deviation 2], the action trend of the expansion valve 6 is to open narrower, and the adjustment speed of the expansion valve 6 is determined based on the difference between $P_1$ and $P_{1,o}$, the larger the difference is, the faster the speed is; the smaller the difference, the slower the speed is.

When $P_{1,o}$−[pressure deviation 2]$\leq P_1 \leq P_{1,o}$+ [pressure deviation 1], the expansion valve 6 maintains its original opening.

The [pressure deviation 1] and the [pressure deviation 2] can be taken between 2-7 bar, depending on the actual operation of the system.

When the hot water system with transcritical carbon dioxide single-stage or double-stage compression is in a mode of the single-stage compression, the step of controlling operation of the single-stage compression comprises:

making the refrigerant circuit bypass valve 14 in an open state, the first-stage compressor 1 stops, the opening of the first proportional valve 9 is 0, and the opening of the second proportional valve 10 is 100%, $$P_{2,0} = f_2(t_{gout}, P_0, t_e)$$

$$f_2(t_{gout}, P_0, t_e) = (3.896 - 0.0223 * t_e) \times t_{gout} + (0.496 * t_e - 10.55) + 1.032 \times P_0^{0.13}$$

Using the obtained $P_{2,o}$ as a target value and comparing it with the actual exhaust pressure $P_2$ of the second-stage compressor 3 actually detected, $\Delta P$ is the pressure correction value and ranges from −5 bar to 10 bar, and according to the difference between $P_2$ and $P_{2,o}$, adjusting the opening of the expansion valve 6 to make $P_2$ close to $P_{2,o}$.

In this embodiment, the working mode of the hot water system with transcritical carbon dioxide single-stage or double-stage compression is: after receiving the startup command, detect the current ambient temperature of the system, if the detected ambient temperature $t_{a1} \leq t_a + \Delta t$, the system operates in the mode of transcritical double-stage compression; if the detected ambient temperature $t_{a1} \geq t_a$, the system operates in the mode of transcritical single-stage compression.

$\Delta t$ may be between 1° C., and 10° C., and $t_a$ may be between −7° C., and −15° C., depending on the specific situation.

Furthermore, in practical operation, when the hot water system operates in the mode of transcritical double-stage compression, the refrigerant circuit bypass valve 14 is in the closed state, and the refrigerant carbon dioxide gas enters the first heat exchanger 2 (condenser) from the exhaust vent driven by the first-stage compressor 1, enters the second-stage compressor 3 after being cooled to a certain temperature by low-temperature water, enters the compressor oil separator 15 after being further compressed in the second-stage compressor 3, enters the second heat exchanger 4 (gas cooler) for cooling after separating the lubricating oil and carbon dioxide gas in the compressor oil separator 15, then passes through the reservoir 18 and the third heat exchanger 5, and turns into low-temperature and low-pressure carbon dioxide gas under the action of the expansion valve 6, absorbs heat from the air in the fourth heat exchanger 7, namely a finned tube evaporator, then passes through the third heat exchanger 5 and returns to the first-stage compressor 1.

When the hot water system is in the mode of transcritical single-stage compression, the refrigerant circuit bypass valve 14 is in an open state, the first-stage compressor 1 is in shutdown state, the opening of the first proportional valve 9 is 0, and the opening of the second proportional valve 10 is 100%. Carbon dioxide gas enters the compressor oil separator 15 from the exhaust vent driven by the second-stage compressor 3, enters the second heat exchanger 4 (gas cooler) for cooling after separating the lubricating oil and carbon dioxide gas in the compressor oil separator 15, passes through the reservoir 18 and the third heat exchanger 5, and turns into low-temperature and low-pressure carbon dioxide gas under the action of the expansion valve 6, absorbs heat from the air in the fourth heat exchanger 7, namely a finned tube evaporator, then passes through the third heat exchanger 5 and returns to the second-stage compressor 3.

Further, the control method further comprises a step of controlling the outlet temperature of the second heat exchanger 4, the step of controlling the outlet temperature of the second heat exchanger 4 comprises:

adjusting the openings of the first proportional valve 9 and the second proportional valve 10 respectively to control the degree of suction superheat $\Delta t_{s2}$ of the second-stage compressor 3, and controlling $\Delta t_{s2}$ to be 5 K-10 K; adjusting the openings of the third proportional valve 11 and the fourth proportional valve 12 respectively, recording the opening of the first proportional valve 9 as $EXP_1$, the opening of the second proportional valve 10 as $EXP_2$, the opening of the third proportional valve 11 as $EXP_3$, and the opening of the fourth proportional valve 12 as $EXP_4$, $EXP_1+EXP_2=EXP_3+EXP_4+\Delta EXP$, wherein $\Delta EXP$ is the opening compensation for hydraulic loss, which can be positive or negative, and is calculated based on the actual flow loss of the system pipeline, usually 3%-6%.

Further, the control method further comprises a step of controlling defrosting, which comprises:

if the surface temperature $t_c$ of the fourth heat exchanger 7 is lower than a setting temperature $t_1$ within a duration $T_1$, the suction pressure $P_1$ of the second-stage compressor 3 is lower than the setting pressure $P_{1s}$ within a duration $T_2$, and $$T_1^a * T_2^{1-a} = T,$$

the transcritical carbon dioxide single-stage or double-stage compression system begins defrosting action, where, $$a = 0.104 - 0.014 * t_a + 2.78 * 10^{-4} * t_a^2 + 4.04 * 10^{-6} * t_a^3 + 2.35 * 10^{-7} * t_a^4,$$

the higher the ambient temperature $t_a$ is, the larger the value of a is; the lower the ambient temperature $t_a$ is, the smaller the value of a is; T is 30 min to 60 min; and when the transcritical carbon dioxide single-stage or double-stage compression system starts defrosting work, the expansion valve 6 is closed, the fan 21 stops, the first proportional valve 9 is closed, the defrosting valve 13 is opened, the first-stage compressor 1 runs to the frequency $Hz_1$, which is the operational frequency of the first-stage compressor 1 and is 50 Hz to 65 Hz, and the second-stage compressor 2 does not stop.

In summary, the hot water system with transcritical carbon dioxide single-stage or double-stage compression and a control method therefor of the present disclosure solve the intermediate pressure control problem of transcritical carbon dioxide double-stage compression, ensuring that the system can be in the optimal operating state under different working conditions, and can also achieve the switching of transcritical first-stage and double-stage compression, taking into account the operating conditions of high and low environmental temperatures. And the present disclosure also solves the defrosting problem of the hot water system with transcritical carbon dioxide single-stage or double-stage compression, improves defrosting efficiency, and reduces false defrosting actions.

In addition, the hot water system with transcritical carbon dioxide single-stage or double-stage compression of the present disclosure not only achieves heat recovery of the single-stage compression, but also achieves precise control of the outlet temperature of the system.

Although the present invention has been disclosed in the form of embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

What is claimed is:

1. A control method for a hot water system with transcritical carbon dioxide compression, wherein the hot water system with transcritical carbon dioxide compression comprises: a first-stage compressor, a first heat exchanger for exchanging heat with cooling water on a user side, a second-stage compressor, a second heat exchanger for exchanging heat with the cooling water on the user side, a third heat exchanger for exchanging heat between a liquid phase refrigerant and a gas phase refrigerant, an expansion valve, a fourth heat exchanger for exchanging heat with ambient air, a buffer water tank, a first proportional valve, a second proportional valve, a third proportional valve, a fourth proportional valve, a defrosting valve, and a refrigerant circuit bypass valve;

wherein the first-stage compressor, the first heat exchanger, the second-stage compressor, the second heat exchanger, a liquid phase refrigerant flow side of the third heat exchanger, the expansion valve, the fourth heat exchanger, and a gas phase refrigerant flow side of the third heat exchanger are sequentially circularly connected;

two ends of the refrigerant circuit bypass valve are respectively connected to the gas phase refrigerant flow side of the third heat exchanger and an air suction inlet of the second-stage compressor, and two ends of the defrosting valve are respectively connected to an exhaust vent of the second-stage compressor and a refrigerant inlet of the fourth heat exchanger;

the buffer water tank, the first proportional valve, the first heat exchanger, the third proportional valve, and the second heat exchanger are sequentially connected, an inlet of the second proportional valve is connected to the buffer water tank, an outlet of the second proportional valve is respectively connected to an inlet of the third proportional valve and an inlet of the fourth proportional valve, the inlet of the fourth proportional valve is further connected to the first heat exchanger, and an outlet of the fourth proportional valve is connected to the buffer water tank;

the control method comprising:

detecting an evaporation pressure $P_0$ of the hot water system, a temperature $t_{gout}$ of the refrigerant at the outlet of the second heat exchanger, and a surface temperature $t_e$ of the fourth heat exchanger, respectively;

recording a target exhaust pressure of the first-stage compressor as $P_{1,o}$; and recording a target exhaust pressure of the second-stage compressor as $P_{2,o}$;

controlling a first controlling operation if the hot water system is in a mode of double-stage compression, the first controlling operation comprises:

making the refrigerant circuit bypass valve in a closed state, solving the following formulas simultaneously:

$$P_{1,o} = \sqrt{P_0 \cdot P_{2,o}} + \Delta P$$

$$P_{2,0} = f_1(t_{gout}, P_{1,0}, t_e)$$

$$f_1(t_{gout}, P_{1,0}, t_e) = (3.896 - 0.0223 * t_e) \times t_{gout} + (0.496 * t_e - 10.55) + 1.032 \times P_{1,0}^{0.13}$$

wherein ΔP is the pressure correction value and ranges from −5 bar to 10 bar, using obtained $P_{1,o}$ and $P_{2,o}$ as target values and comparing the target values with an actual exhaust pressure $P_1$ of the first-stage compressor and an actual exhaust pressure $P_2$ of the second-stage compressor which are detected, and according to a difference between $P_1$ and $P_{1,o}$ and a difference between $P_2$ and $P_{2,o}$, adjusting an opening of the expansion valve and an operating frequency of the first-stage compressor to make $P_1$ close to $P_{1,o}$, and $P_2$ close to $P_{2,o}$;

controlling a second controlling operation if the hot water system is in a mode of single-stage compression, the second controlling operation comprises:

making the refrigerant circuit bypass valve in an open state, shutting down the first-stage compressor, adjusting an opening of the first proportional valve to 0 and an opening of the second proportional valve to 100%, solving the following formulas:

$$P_{2,0} = f_2(t_{gout}, P_0, t_e)$$

$$f_2(t_{gout}, P_0, t_e) = (3.896 - 0.0223 * t_e) \times t_{gout} + (0.496 * t_e - 10.55) + 1.032 \times P_0^{0.13}$$

wherein ΔP is the pressure correction value and ranges from −5 bar to 10 bar, using an obtained $P_{2,o}$ as a target value and comparing it with the actual exhaust pressure $P_2$ of the second-stage compressor actually detected, and according to the difference between $P_2$ and $P_{2,o}$, adjusting the opening of the expansion valve to make $P_2$ close to $P_{2,o}$;

wherein the control method further comprises controlling an outlet temperature of the second heat exchanger, including:

adjusting the openings of the first proportional valve and the second proportional valve respectively to control a degree of suction superheat Δts2 to be 5 K-10 K; adjusting openings of the third proportional valve and the fourth proportional valve respectively, recording the opening of the first proportional valve as $EXP_1$, the opening of the second proportional valve as $EXP_2$, the opening of the third proportional valve as $EXP_3$, and the opening of the fourth proportional valve as $EXP_4$, and controlling $EXP_1+EXP_2=EXP_3+EXP_4+\Delta EXP$, wherein ΔEXP is an opening compensation for hydraulic loss and is 3%-6%;

wherein the control method further comprises controlling defrosting, including:

if the surface temperature $t_e$ of the fourth heat exchanger is lower than a setting temperature $t_1$ within a duration $T_1$, the suction pressure $P_1$ of the second-stage compressor is lower than a setting pressure $P_{1s}$ within a duration $T_2$, and $$T_1^a * T_2^{1-a} = T,$$

starting defrosting, wherein, $$a = 0.104 - 0.014 * t_a + 2.78 * 10^{-4} * t_a^2 + 4.04 * 10^{-6} * t_a^3 + 2.35 * 10^{-7} * t_a^4,$$

is 30 min to 60 min; and when starting defrosting, closing the expansion valve, shutting down the fan, closing the first proportional valve, opening the defrosting valve, making the first-stage compressor runs to the frequency $Hz_1$, which is an operational frequency of the first-stage compressor and is 50 Hz to 65 Hz, and making the second-stage compressor does not shutdown.

2. The control method for a hot water system with transcritical carbon dioxide compression according to claim 1, wherein the hot water system with transcritical carbon dioxide compression further comprises a compressor oil separator, the compressor oil separator comprises an oil separator refrigerant inlet, an oil separator refrigerant outlet, and an oil separator lubricating oil outlet, wherein the oil separator refrigerant inlet is connected to the exhaust vent of the second-stage compressor, and the oil separator refrigerant outlet is respectively connected to the second heat exchanger and the defrosting valve, and the oil separator lubricating oil outlet is respectively connected to an oil return opening of the first-stage compressor and an oil return opening of the second-stage compressor.

3. The control method for a hot water system with transcritical carbon dioxide compression according to claim 2, wherein the hot water system with transcritical carbon dioxide compression further comprises a first oil circuit solenoid valve and a second oil circuit solenoid valve, two ends of the first oil circuit solenoid valve is respectively connected to the oil separator lubricating oil outlet and the oil return opening of the second-stage compressor, and two ends of the second oil circuit solenoid valve is respectively connected to the oil separator lubricating oil outlet and the oil return opening of the first-stage compressor.

4. The control method for a hot water system with transcritical carbon dioxide compression according to claim 1, wherein the hot water system with transcritical carbon dioxide compression further comprises a reservoir, which is respectively connected to a refrigerant outlet of the second heat exchanger and the liquid phase refrigerant flow side of the third heat exchanger; and/or, the hot water system with transcritical carbon dioxide single-stage or double stage compression further comprises a gas-liquid separator, which is respectively connected to the fourth heat exchanger and the gas phase refrigerant flow side of the third heat exchanger.

5. The control method for a hot water system with transcritical carbon dioxide compression according to claim 1, wherein the hot water system with transcritical carbon dioxide compression further comprises a water pump, which is respectively connected to the buffer water tank, the first proportional valve and the second proportional valve; and/or, the hot water system with transcritical carbon dioxide compression further comprises a fan for blowing ambient air to the fourth heat exchanger and directly facing the fourth heat exchanger.

6. The control method for a hot water system with transcritical carbon dioxide compression according to claim 1, wherein the first-stage compressor is a variable frequency compressor, the second-stage compressor is a fixed frequency compressor, and the fourth heat exchanger is a finned tube evaporator.

7. The control method for a hot water system with transcritical carbon dioxide compression according to claim 1, wherein the hot water system with transcritical carbon dioxide compression further comprises an environmental temperature sensor, a buffer water tank outlet temperature sensor, a first heat exchanger outlet temperature sensor, a second heat exchanger outlet temperature sensor, a first-stage compressor exhaust pressure sensor, a first-stage compressor exhaust temperature sensor, a first-stage compressor suction pressure sensor, a first-stage compressor suction temperature sensor, a second-stage compressor exhaust pressure sensor, a second-stage compressor exhaust temperature sensor, a second-stage compressor suction pressure sensor, a second-stage compressor suction temperature sensor, a second heat exchanger refrigerant outlet temperature sensor, a fourth heat exchanger surface temperature sensor, and a fourth heat exchanger refrigerant evaporation pressure sensor;

wherein the buffer water tank outlet temperature sensor is arranged at an outlet of the buffer water tank, the first heat exchanger outlet temperature sensor is arranged at an outlet of the first heat exchanger, the second heat exchanger outlet temperature sensor is arranged at the outlet of the second heat exchanger, the first-stage compressor exhaust pressure sensor and the first-stage compressor exhaust temperature sensor are respectively arranged at an exhaust vent of the first-stage compressor, the first-stage compressor suction pressure sensor and the first-stage compressor suction temperature sensor are respectively arranged at an air suction inlet of the first-stage compressor, the second-stage compressor exhaust pressure sensor and the second-stage compressor exhaust temperature sensor are respectively arranged at the exhaust vent of the second-stage compressor, the second-stage compressor suction pressure sensor and the second-stage compressor suction temperature sensor are respectively arranged at the air suction inlet of the second-stage compressor, the second heat exchanger refrigerant outlet temperature sensor is arranged at an refrigerant outlet of the second heat exchanger, and the fourth heat exchanger surface temperature sensor and the fourth heat exchanger refrigerant evaporation pressure sensor are arranged on the fourth heat exchanger.

8. A hot water system with transcritical carbon dioxide compression, comprising: a first-stage compressor, a first heat exchanger for exchanging heat with cooling water on user side, a second-stage compressor, a second heat exchanger for exchanging heat with the cooling water on user side, a third heat exchanger for exchanging heat between a liquid phase refrigerant and a gas phase refrigerant, an expansion valve, a fourth heat exchanger for exchanging heat with ambient air, a buffer water tank, a first proportional valve, a second proportional valve, a third proportional valve, a fourth proportional valve, a defrosting valve, and a refrigerant circuit bypass valve;

wherein the first-stage compressor, the first heat exchanger, the second-stage compressor, the second heat exchanger, a liquid phase refrigerant flow side of the third heat exchanger, the expansion valve, the fourth heat exchanger, and a gas phase refrigerant flow side of the third heat exchanger are sequentially circularly connected;

two ends of the refrigerant circuit bypass valve are respectively connected to the gas phase refrigerant flow side of the third heat exchanger and an air suction inlet of the second-stage compressor, and two ends of the defrosting valve are respectively connected to an exhaust vent of the second-stage compressor and a refrigerant inlet of the fourth heat exchanger;

the buffer water tank, the first proportional valve, the first heat exchanger, the third proportional valve, and the second heat exchanger are sequentially connected, an inlet of the second proportional valve is connected to the buffer water tank, an outlet of the second proportional valve is respectively connected to an inlet of the third proportional valve and an inlet of the fourth proportional valve, the inlet of the fourth proportional valve is further connected to the first heat exchanger, and an outlet of the fourth proportional valve is connected to the buffer water tank.

9. The hot water system with transcritical carbon dioxide compression according to claim 8, further comprising a compressor oil separator, the compressor oil separator comprises an oil separator refrigerant inlet, an oil separator refrigerant outlet, and an oil separator lubricating oil outlet, wherein the oil separator refrigerant inlet is connected to the exhaust vent of the second-stage compressor, and the oil separator refrigerant outlet is respectively connected to the second heat exchanger and the defrosting valve, and the oil separator lubricating oil outlet is respectively connected to an oil return opening of the first-stage compressor and an oil return opening of the second-stage compressor.

10. The hot water system with transcritical carbon dioxide compression according to claim 9, further comprising a first oil circuit solenoid valve and a second oil circuit solenoid valve, two ends of the first oil circuit solenoid valve is respectively connected to the oil separator lubricating oil outlet and the oil return opening of the second-stage compressor, and two ends of the second oil circuit solenoid valve is respectively connected to the oil separator lubricating oil outlet and the oil return opening of the first-stage compressor.

11. The hot water system with transcritical carbon dioxide compression according to claim 8, further comprising a reservoir, which is respectively connected to a refrigerant outlet of the second heat exchanger and the liquid phase refrigerant flow side of the third heat exchanger; and/or, the hot water system with transcritical carbon dioxide compression further comprises a gas-liquid separator, which is respectively connected to the fourth heat exchanger and the gas phase refrigerant flow side of the third heat exchanger.

12. The hot water system with transcritical carbon dioxide compression according to claim 8, further comprising a water pump, which is respectively connected to the buffer water tank, the first proportional valve and the second proportional valve; and/or, the hot water system with transcritical carbon dioxide compression further comprises a fan for blowing ambient air to the fourth heat exchanger and directly facing the fourth heat exchanger.

13. The hot water system with transcritical carbon dioxide compression according to claim 8, wherein the first-stage compressor is a variable frequency compressor, the second-stage compressor is a fixed frequency compressor, and the fourth heat exchanger is a finned tube evaporator.

14. The hot water system with transcritical carbon dioxide compression according to claim 8, further comprising an environmental temperature sensor, a buffer water tank outlet temperature sensor, a first heat exchanger outlet temperature sensor, a second heat exchanger outlet temperature sensor, a first-stage compressor exhaust pressure sensor, a first-stage compressor exhaust temperature sensor, a first-stage compressor suction pressure sensor, a first-stage compressor suction temperature sensor, a second-stage compressor exhaust pressure sensor, a second-stage compressor exhaust temperature sensor, a second-stage compressor suction pressure sensor, a second-stage compressor suction temperature sensor, a second heat exchanger refrigerant outlet temperature sensor, a fourth heat exchanger surface temperature sensor, and a fourth heat exchanger refrigerant evaporation pressure sensor;

wherein the buffer water tank outlet temperature sensor is arranged at an outlet of the buffer water tank, the first heat exchanger outlet temperature sensor is arranged at an outlet of the first heat exchanger, the second heat exchanger outlet temperature sensor is arranged at the outlet of the second heat exchanger, the first-stage compressor exhaust pressure sensor and the first-stage compressor exhaust temperature sensor are respectively arranged at an exhaust vent of the first-stage compressor, the first-stage compressor suction pressure sensor and the first-stage compressor suction temperature sensor are respectively arranged at an air suction inlet of the first-stage compressor, the second-stage compressor exhaust pressure sensor and the second-stage compressor exhaust temperature sensor are respectively arranged at the exhaust vent of the second-stage compressor, the second-stage compressor suction pressure sensor and the second-stage compressor suction temperature sensor are respectively arranged at the air suction inlet of the second-stage compressor, the second heat exchanger refrigerant outlet temperature sensor is arranged at an refrigerant outlet of the second heat exchanger, and the fourth heat exchanger surface temperature sensor and the fourth heat exchanger refrigerant evaporation pressure sensor are arranged on the fourth heat exchanger.

15. A control method for a hot water system with transcritical carbon dioxide compression according to claim 1, comprising detecting an evaporation pressure $P_0$ of the hot water system, a temperature $t_{gout}$ of the refrigerant at the outlet of the second heat exchanger, and a surface temperature $t_e$ of the fourth heat exchanger, respectively, recording a target exhaust pressure of the first-stage compressor as $P_{1,o}$, and recording a target exhaust pressure of the second-stage compressor as $P_{2,o}$;

controlling the first controlling operation if the hot water system is in a mode of double-stage compression, the first controlling operation comprises:

making the refrigerant circuit bypass valve is in a closed state, solving the following formulas simultaneously:

$$P_{1,o} = \sqrt{P_0 \cdot P_{2,o}} + \Delta P$$

$$P_{2,0} = f_1(t_{gout}, P_{1,0}, t_e)$$

$$f_1(t_{gout}, P_{1,0}, t_e) =$$

-continued $$(3.896 - 0.0223 * t_e) \times t_{gout} + (0.496 * t_e - 10.55) + 1.032 \times P_{1,0}^{0.13}$$

wherein ΔP is the pressure correction value and ranges from −5 bar to 10 bar, using obtained $P_{1,o}$ and $P_{2,o}$ as target values and comparing them with an actual exhaust pressure $P_1$ of the first-stage compressor and an actual exhaust pressure $P_2$ of the second-stage compressor which are actually detected, and according to a difference between $P_1$ and $P_{1,o}$ and a difference between $P_2$ and $P_{2,o}$, adjusting an opening of the expansion valve and an operating frequency of the first-stage compressor to make $P_1$ close to $P_{1,o}$, and $P_2$ close to $P_{2,o}$;

controlling the second controlling operation if the hot water system is in a mode of single-stage compression, the second controlling operation comprises:

making the refrigerant circuit bypass valve in an open state, shutting down the first-stage compressor, adjusting an opening of the first proportional valve to 0 and an opening of the second proportional valve to 100%, solving the following formulas:

$$P_{2,0} = f_2(t_{gout}, P_0, t_e)$$

$$f_2(t_{gout}, P_0, t_e) =$$

$$(3.896 - 0.0223 * t_e) \times t_{gout} + (0.496 * t_e - 10.55) + 1.032 \times P_0^{0.13}$$

wherein ΔP is the pressure correction value and ranges from −5 bar to 10 bar, using an obtained $P_{2,o}$ as a target value and comparing it with the actual exhaust pressure $P_2$ of the second-stage compressor actually detected, and according to the difference between $P_2$ and $P_{2,o}$, adjusting the opening of the expansion valve 6 to make $P_2$ close to $P_{2,o}$.

16. The control method for a hot water system with transcritical carbon dioxide compression according to claim 15, further comprising controlling an outlet temperature of the second heat exchanger, including:

adjusting the openings of the first proportional valve and the second proportional valve respectively to control a degree of suction superheat $\Delta t_{s2}$ to be 5 K-10 K; adjusting openings of the third proportional valve and the fourth proportional valve respectively, recording the opening of the first proportional valve as $EXP_1$, the opening of the second proportional valve as $EXP_2$, the opening of the third proportional valve as $EXP_3$, and the opening of the fourth proportional valve as $EXP_4$, and controlling $EXP_1+EXP_2=EXP_3+EXP_4+\Delta EXP$, wherein ΔEXP is an opening compensation for hydraulic loss and is 3%-6%.

17. The control method for a hot water system with transcritical carbon dioxide compression according to claim 15, further comprising controlling defrosting comprising:

if the surface temperature $t_e$ of the fourth heat exchanger is lower than a setting temperature $t_1$ within a duration $T_1$, the suction pressure $P_1$ of the second-stage compressor is lower than a setting pressure $P_{1s}$ within a duration $T_2$, and $$T_1^a * T_2^{1-a} = T$$

starting defrosting, wherein, $$a = 0.104 - 0.014 * t_a + 2.78 * 10^{-4} * t_a^2 + 4.04 * 10^{-6} * t_a^3 + 2.35 * 10^{-7} * t_a^4,\ T$$

is 30 min to 60 min; and when starting defrosting work, closing the expansion valve, shutting down the fan stops, closing the first proportional valve, opening the defrosting valve, making the first-stage compressor runs to the frequency $Hz_1$, which is an operational frequency of the first-stage compressor and is 50 Hz to 65 Hz, and making the second-stage compressor does not shutdown.

* * * * *